US008273216B2

(12) United States Patent
Solhage et al.

(10) Patent No.: US 8,273,216 B2
(45) Date of Patent: Sep. 25, 2012

(54) PROCESS FOR THE PRODUCTION OF PAPER

(75) Inventors: Fredrik Solhage, Borås (SE); Joakim Carlén, Göteborg (SE); Birgitta Johansson, Nödinge (SE)

(73) Assignee: Akzo Nobel N.V., Arnhem (NL)

( * ) Notice: Subject to any disclaimer, the term of this patent is extended or adjusted under 35 U.S.C. 154(b) by 203 days.

(21) Appl. No.: 11/642,390

(22) Filed: Dec. 20, 2006

(65) Prior Publication Data

US 2007/0151688 A1 Jul. 5, 2007

Related U.S. Application Data

(60) Provisional application No. 60/755,350, filed on Dec. 30, 2005.

(51) Int. Cl.

| | |
|---|---|
| ***D21H 17/29*** | (2006.01) |
| ***D21H 17/45*** | (2006.01) |
| ***D21H 17/63*** | (2006.01) |
| ***D21H 21/10*** | (2006.01) |

(52) U.S. Cl. ..... 162/168.3; 162/158; 162/164.1; 162/164.6; 162/175; 162/181.6; 162/185

(58) Field of Classification Search ..... 162/158, 162/164.1, 164.6, 168.3, 175, 181.6, 185
See application file for complete search history.

(56) References Cited

U.S. PATENT DOCUMENTS

| | | | | |
|---|---|---|---|---|
| 4,066,495 | A | 1/1978 | Voigt et al. | 162/168 NA |
| 4,305,781 | A | 12/1981 | Langley et al. | |
| 4,388,150 | A | 6/1983 | Sunden et al. | 162/175 |
| 4,749,444 | A | 6/1988 | Lorz et al. | |
| 4,750,974 | A | 6/1988 | Johnson | 162/164.1 |
| 4,795,531 | A | 1/1989 | Sofia et al. | |
| 4,913,775 | A * | 4/1990 | Langley et al. | 162/164.3 |
| 4,927,498 | A | 5/1990 | Rushmere | 162/168.3 |
| 4,954,220 | A | 9/1990 | Rushmere | 162/168.3 |
| 4,961,825 | A | 10/1990 | Andersson et al. | 162/175 |
| 4,980,025 | A | 12/1990 | Andersson et al. | 162/168.3 |
| 5,127,994 | A | 7/1992 | Johansson | 162/168.3 |
| 5,167,766 | A | 12/1992 | Honig et al. | 162/164.1 |
| 5,171,808 | A | 12/1992 | Ryles et al. | |
| 5,176,891 | A | 1/1993 | Rushmere | 423/328.1 |
| 5,185,061 | A | 2/1993 | Lowry et al. | |
| 5,368,833 | A | 11/1994 | Johansson et al. | 423/338 |
| 5,447,604 | A | 9/1995 | Johansson et al. | 162/181.6 |
| 5,470,435 | A | 11/1995 | Rushmere et al. | 162/181.6 |
| 5,501,771 | A | 3/1996 | Bourson | 162/158 |
| 5,529,699 | A * | 6/1996 | Kuo et al. | 210/735 |
| 5,543,014 | A | 8/1996 | Rushmere et al. | 162/181.6 |
| 5,571,494 | A | 11/1996 | Saastamoinen | 423/338 |
| 5,573,674 | A | 11/1996 | Lind et al. | 210/702 |
| 5,584,966 | A | 12/1996 | Moffett | 162/168.1 |
| 5,595,629 | A | 1/1997 | Begala | |
| 5,595,630 | A | 1/1997 | Moffett | |
| 5,603,805 | A | 2/1997 | Andersson et al. | 162/168.3 |
| 5,676,796 | A | 10/1997 | Cutts | |
| 5,688,482 | A | 11/1997 | Saastamoinen | 423/335 |
| 5,707,493 | A | 1/1998 | Saastamoinen | 162/164.1 |
| 5,846,384 | A * | 12/1998 | Schold et al. | 162/175 |
| 5,858,174 | A * | 1/1999 | Persson et al. | 162/164.1 |
| 6,033,525 | A | 3/2000 | Moffett | 162/175 |
| 6,083,348 | A * | 7/2000 | Auhorn et al. | 162/183 |
| 6,100,322 | A * | 8/2000 | Persson et al. | 524/418 |
| 6,103,064 | A | 8/2000 | Asplund et al. | |
| 6,103,065 | A * | 8/2000 | Humphreys et al. | 162/181.8 |
| 6,168,686 | B1 | 1/2001 | Sutman et al. | |
| 6,454,902 | B1 | 9/2002 | Chen | 162/168.1 |
| 6,524,439 | B2 * | 2/2003 | Chen et al. | 162/168.1 |
| 6,551,457 | B2 * | 4/2003 | Westman et al. | 162/158 |
| 2003/0139517 | A1 | 7/2003 | Nyander et al. | 524/492 |
| 2004/0250972 | A1 * | 12/2004 | Carr | 162/164.1 |
| 2005/0247420 | A1 * | 11/2005 | Blum et al. | 162/158 |
| 2006/0130991 | A1 * | 6/2006 | Solhage et al. | 162/158 |
| 2008/0227980 | A1 | 9/2008 | Portmann et al. | |

FOREIGN PATENT DOCUMENTS

| | | | |
|---|---|---|---|
| EP | 0 234 513 | B1 | 9/1987 |
| EP | 0 234 513 | B2 | 9/1987 |
| EP | 0 490 425 | B1 | 6/1992 |
| EP | 0 522 940 | B1 | 1/1993 |
| EP | 1 039 026 | B1 | 9/2000 |
| EP | 1 238 161 | B1 | 5/2001 |
| JP | 01-162897 | A | 6/1989 |
| JP | 2002-513102 | A | 5/2002 |
| JP | 2005-195486 | A | 7/2005 |
| JP | 2006-501348 | | 1/2006 |
| JP | 2009-503034 | A | 1/2009 |
| TW | 200400305 | | 1/2004 |
| TW | 200426275 | | 12/2004 |
| WO | WO 91/07543 | A1 | 5/1991 |
| WO | WO 95/33097 | A1 | 12/1995 |
| WO | WO 97/04168 | A1 | 2/1997 |
| WO | WO 99/14432 | A1 | 3/1999 |

(Continued)

OTHER PUBLICATIONS

Wurzburg, "Modified Starches: Properties and Uses", CRC Press, Boca Raton, FL, 2000, pp. 113-116.* Greenberg, S.A. "The Chemistry of Silicic Acid" Journal of Chemical Education, vol. 36, No. 5, 1959, pp. 218-219.*

Japanese Office Action for Japanese Application No. 2007-548139 dated Feb. 9, 2010.

English Language Translation of the Japanese Office Action for Japanese Application No. 2007-548139 dated Feb. 9, 2010.

Taiwanese Examination Report for Taiwan Patent Application No. 95148730.

English language translation of Taiwanese Examination Report for Taiwan Patent Application No. 95148730.

USPTO Non-Final Office Action dated Mar. 27, 2008 relating to case U.S. Appl. No. 11/302,941 filed Dec. 14, 2005.

USPTO Final Office Action dated Dec. 31, 2008 relating to case U.S. Appl. No. 11/302,941 filed Dec. 14, 2005.

USPTO Non-Final Office Action dated May 4, 2009 relating to case U.S. Appl. No. 11/302,941 filed Dec. 14, 2005.

(Continued)

*Primary Examiner* — Matthew Daniels
*Assistant Examiner* — Dennis Cordray
(74) *Attorney, Agent, or Firm* — Robert C. Morriss

(57) ABSTRACT

The present invention relates to a process for producing paper which comprises: providing an aqueous suspension comprising cellulosic fibers, adding to the suspension, after all points of high shear, a cationic polysaccharide; and a polymer P2 being an anionic polymer; and, dewatering the obtained suspension to form paper.

14 Claims, No Drawings

FOREIGN PATENT DOCUMENTS

| | | | | |
|---|---|---|---|---|
| WO | WO 99/55962 | A2 | | 11/1999 |
| WO | WO 00/11267 | A1 | | 3/2000 |
| WO | WO 01/34910 | | * | 5/2001 |
| WO | WO 01/34910 | A1 | | 5/2001 |
| WO | WO 02/33171 | A1 | | 4/2002 |
| WO | WO 03/064767 | A1 | | 8/2003 |
| WO | WO 2004/015200 | | | 2/2004 |
| WO | WO 2004/015200 | A1 | | 2/2004 |
| WO | WO 2004/031478 | A1 | | 4/2004 |
| WO | WO 2004/104299 | A1 | | 12/2004 |
| WO | WO 2005/116336 | A1 | | 8/2005 |

OTHER PUBLICATIONS

USPTO Final Office Action dated Feb. 3, 2010 relating to case U.S. Appl. No. 11/302,941 filed Dec. 14, 2005 .

English translation of WO 2005/116336 A1. Date: 2006.

"Bentonite", product information sheet, Arokor Holdings, Inc. [online] [retrieved from the Internet on Dec. 28, 2008].

Falcone, J. "Silicon Compounds: Anthropogenic Silicas and Silicates," Kirk-Othmer Encyclopedia of Chemical Tehnology, 2001, by John Wiley & Sons, Inc., pp. 1-6.

Sears, Jr., G. W., "Determination of Specific Surface Area of Colloidal Silica by Titration with Sodium Hydroxide," Analytical Chem., vol. 28, No. 12 (1956), pp. 1981-1983.

Iler, Ralph K. et al., "Degree of Hydration of Particles of Colloidal Silica in Aqueous Solution," J. Phys. Chem., vol. 60 (1956) pp. 955-957.

Japanese Office Action for JP 2008-548467 dated Jul. 5, 2011.

English translation of Japanese Office Action for JP 2008-548467 dated Jul. 5, 2011.

Japanese Office Action for JP 2008-548467 dated Jan. 17, 2012.

English translation of Japanese Office Action for JP 2008-548467 dated Jan. 17, 2012.

English lanugage abstract for JP 2005-195486, Jul. 21, 2005.

* cited by examiner

PROCESS FOR THE PRODUCTION OF PAPER

The present invention relates to a process for the production of paper. More specifically, the invention relates to a process for the production of paper which comprises adding cationic starch and a polymer P2 to an aqueous cellulosic suspension after all points of high shear and dewatering the obtained suspension to form paper.

BACKGROUND

In the art of papermaking, an aqueous suspension containing cellulosic fibres, and optional fillers and additives, referred to as stock, is fed through pumps, screens and cleaners, which subject the stock to high shear forces, into a headbox which ejects the stock onto a forming wire. Water is drained from the stock through the forming wire so that a wet web of paper is formed on the wire, and the web is further dewatered and dried in the drying section of the paper machine. Drainage and retention aids are conventionally introduced at different points in the flow of stock in order to facilitate drainage and increase adsorption of fine particles such as fine fibres, fillers and additives onto the cellulose fibres so that they are retained with the fibres on the wire. Examples of conventionally used drainage and retention aids include organic polymers, inorganic materials, and combinations thereof.

EP 0 234513 A1, WO 91/07543 A1, WO 95/33097 A1 and WO 01/34910 A1 disclose the use of cationic starch and an anionic polymer in paper-making processes. However, there is nothing disclosed about adding both these components to the suspension after all points of high shear.

It would be advantageous to be able to provide a papermaking process with further improvements in drainage, retention and formation.

THE INVENTION

According to the present invention it has been found that drainage can be improved without any significant impairment of retention and paper formation, or even with improvements in retention and paper formation, by a process for producing paper which comprises: (i) providing an aqueous suspension comprising cellulosic fibres, (ii) adding to the suspension after all points of high shear: a cationic polysaccharide and a polymer P2 being an anionic polymer; and, (iii) dewatering the obtained suspension to form paper. The present invention provides improvements in drainage and retention in the production of paper from all types of stocks, in particular stocks containing mechanical or recycled pulp, and stocks having high contents of salts (high conductivity) and colloidal substances, and in papermaking processes with a high degree of white water closure, i.e. extensive white water recycling and limited fresh water supply. Hereby the present invention makes it possible to increase the speed of the paper machine and to use lower dosages of polymers to give corresponding drainage and/or retention effects, thereby leading to an improved papermaking process and economic benefits.

The term "drainage and retention aids", as used herein, refers to two or more components which, when added to an aqueous cellulosic suspension, give better drainage and retention than is obtained when not adding the said two or more components.

The cationic polysaccharide according to this invention can be selected from any polysaccharide known in the art including, for example, starches, guar gums, celluloses, chitins, chitosans, glycans, galactans, glucans, xanthan gums, pectins, mannans, dextrins, preferably starches and guar gums. Examples of suitable starches include potato, corn, wheat, tapioca, rice, waxy maize, barley etc. Suitably the cationic polysaccharide is water-dispersable or, preferably, water-soluble.

Particularly suitable polysaccharides according to the invention include those comprising the general structural formula (I):

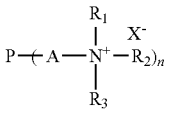

(I)

wherein P is a residue of a polysaccharide; A is a group attaching N to the polysaccharide residue, suitably a chain of atoms comprising C and H atoms, and optionally O and/or N atoms, usually an alkylene group with from 2 to 18 and suitably 2 to 8 carbon atoms, optionally interrupted or substituted by one or more heteroatoms, e.g. O or N, e.g. an alkyleneoxy group or hydroxy propylene group (—$CH_2$—CH(OH)—$CH_2$—); $R_1$, $R_2$, and $R_3$ are each H or, preferably, a hydrocarbon group, suitably alkyl, having from 1 to 3 carbon atoms, suitably 1 or 2 carbon atoms; n is an integer from about 2 to about 300,000, suitably from 5 to 200,000 and preferably from 6 to 125,000 or, alternatively, $R_1$, $R_2$ and $R_3$ together with N form a aromatic group containing from 5 to 12 carbon atoms; and $X^-$ is an anionic counterion, usually a halide like chloride.

Cationic polysaccharides according to the invention may also contain anionic groups, preferably in a minor amount. Such anionic groups may be introduced in the polysaccharide by means of chemical treatment or be present in the native polysaccharide.

The weight average molecular weight of the cationic polysaccharide an vary within wide limits dependent on, inter alia, the type of polymer used, and usually it is at least about 5,000 and often at least 10,000. More often, it is above 150,000, normally above 500,000, suitably above about 700,000, preferably above about 1,000,000 and most preferably above about 2,000,000. The upper limit is not critical; it can be about 200,000,000, usually 150,000,000 and suitably 100,000,000.

The cationic polysaccharide can have a degree of cationic substitution ($DS_C$) varying over a wide range dependent on, inter alia, the type of polymer used; $DS_C$ can be from 0.005 to 1.0, usually from 0.01 to 0.5, suitably from 0.02 to 0.3, preferably from 0.025 to 0.2.

Usually the charge density of the cationic polysaccharide is within the range of from 0.05 to 6.0 meq/g of dry polymer, suitably from 0.1 to 5.0 and preferably from 0.2 to 4.0.

The polymer P2 according to the present invention is an anionic polymer which can be selected from inorganic and organic anionic polymers. Examples of suitable polymers P2 include water-soluble and water-dispersible inorganic and organic anionic polymers.

Examples of suitable polymers P2 include inorganic anionic polymers based on silicic acid and silicate, i.e., anionic silica-based polymers. Suitable anionic silica-based polymers can be prepared by condensation polymerisation of siliceous compounds, e.g. silicic acids and silicates, which can be homopolymerised or co-polymerised. Preferably, the anionic silica-based polymers comprise anionic silica-based particles that are in the colloidal range of particle size.

Anionic silica-based particles are usually supplied in the form of aqueous colloidal dispersions, so-called sols. The silica-based sols can be modified and contain other elements, e.g. aluminium, boron, nitrogen, zirconium, gallium and titanium, which can be present in the aqueous phase and/or in the silica-based particles. Examples of suitable anionic silica-based particles include polysilicic acids, polysilicic acid microgels, polysilicates, polysilicate microgels, colloidal silica, colloidal aluminium-modified silica, polyaluminosilicates, polyaluminosilicate microgels, polyborosilicates, etc. Examples of suitable anionic silica-based particles include those disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,573,674; 5,584,966; 5,603,805; 5,688,482; and 5,707,493; which are hereby incorporated herein by reference.

Examples of suitable anionic silica-based particles include those having an average particle size below about 100 nm, preferably below about 20 nm and more preferably in the range of from about 1 to about 10 nm. As conventional in the silica chemistry, the particle size refers to the average size of the primary particles, which may be aggregated or non-aggregated. Preferably, the anionic silica-based polymer comprises aggregated anionic silica-based particles. The specific surface area of the silica-based particles is suitably at least 50 $m^2/g$ and preferably at least 100 $m^2/g$. Generally, the specific surface area can be up to about 1700 $m^2/g$ and preferably up to 1000 $m^2/g$. The specific surface area is measured by means of titration with NaOH as described by G. W. Sears in Analytical Chemistry 28(1956): 12, 1981-1983 and in U.S. Pat. No. 5,176,891 after appropriate removal of or adjustment for any compounds present in the sample that may disturb the titration like aluminium and boron species. The given area thus represents the average specific surface area of the particles.

In a preferred embodiment of the invention, the anionic silica-based particles have a specific surface area within the range of from 50 to 1000 $m^2/g$, more preferably from 100 to 950 $m^2/g$. Preferably, the silica-based particles are present in a sol having a S-value in the range of from 8 to 50%, preferably from 10 to 40%, containing silica-based particles with a specific surface area in the range of from 300 to 1000 $m^2/g$, suitably from 500 to 950 $m^2/g$, and preferably from 750 to 950 $m^2/g$, which sols can be modified as mentioned above. The S-value is measured and calculated as described by Iler & Dalton in J. Phys. Chem. 60(1956), 955-957. The S-value indicates the degree of aggregation or microgel formation and a lower S-value is indicative of a higher degree of aggregation.

In yet another preferred embodiment of the invention, the silica-based particles have a high specific surface area, suitably above about 1000 $m^2/g$. The specific surface area can be in the range of from 1000 to 1700 $m^2/g$ and preferably from 1050 to 1600 $m^2/g$.

Further examples of suitable polymers P2 include water-soluble and water-dispersible organic anionic polymers obtained by polymerizing an ethylenically unsaturated anionic or potentially anionic monomer or, preferably, a monomer mixture comprising one or more ethylenically unsaturated anionic or potentially anionic monomers, and optionally one or more other ethylenically unsaturated monomers. Preferably, the ethylenically unsaturated monomers are water-soluble. Examples of suitable anionic and potentially anionic monomers include ethylenically unsaturated carboxylic acids and salts thereof, ethylenically unsaturated sulphonic acids and salts thereof, e.g. any one of those mentioned above. The monomer mixture can contain one or more water-soluble ethylenically unsaturated non-ionic monomers. Examples of suitable copolymerizable non-ionic monomers include acrylamide and the above-mentioned non-ionic acrylamide-based and acrylate-based monomers and vinylamines. The monomer mixture can also contain one or more water-soluble ethylenically unsaturated cationic and potentially cationic monomers, preferably in minor amounts. Examples of suitable copolymerizable cationic monomers include the monomers represented by the above general structural formula (I) and diallyldialkyl ammonium halides, e.g. diallyldimethyl ammonium chloride. The monomer mixture can also contain one or more polyfunctional crosslinking agents. The presence of a polyfunctional crosslinking agent in the monomer mixture renders possible preparation of polymers P2 that are water-dispersible. Examples of suitable polyfunctional crosslinking agents including the above-mentioned polyfunctional crosslinking agents. These agents can be used in the above-mentioned amounts. Examples of suitable water-dispersible organic anionic polymers include those disclosed in U.S. Pat. No. 5,167,766, which is incorporated herein by reference. Examples of preferred copolymerizable monomers include (meth)acrylamide, and examples of preferred polymers P2 include water-soluble and water-dispersible anionic acrylamide-based polymers.

The polymer P2 being an organic anionic polymer according to the invention, preferably an organic anionic polymer that is water-soluble, has a weight average molecular weight of at least about 500,000. Usually, the weight average molecular weight is at least about 1 million, suitably at least about 2 million and preferably at least about 5 million. The upper limit is not critical; it can be about 50 million, usually 30 million.

The polymer P2 being an organic anionic polymer can have a charge density less than about 14 meq/g, suitably less than about 10 meq/g, preferably less than about 4 meq/g. Suitably, the charge density is in the range of from about 1.0 to about 14.0, preferably from about 2.0 to about 10.0 meq/g.

In one embodiment of the present invention the process for producing paper further comprises adding a polymer P1 being a cationic polymer to the suspension after all points of high shear.

The optional polymer P1 according to the present invention is a cationic polymer having a charge density of suitably at least 2.5 meq/g, preferably at least 3.0 meq/g. Suitably, the charge density is in the range of from 2.5 to 10.0, preferably from 3.0 to 8.5 meq/g.

The polymer P1 can be selected from inorganic and organic cationic polymers. Preferably, the polymer P1 is water-soluble. Examples of suitable polymers P1 include polyaluminium compounds, e.g. polyaluminium chlorides, polyaluminium sulphates, polyaluminium compounds containing both chloride and sulphate ions, polyaluminium silicate-sulphates, and mixtures thereof.

Further examples of suitable polymers P1 include cationic organic polymers, e.g. cationic acrylamide-based polymers; poly(diallyldialkyl ammonium halides), e.g. poly(diallyldimethyl ammonium chloride); polyethylene imines; polyamidoamines; polyamines; and vinylamine-based polymers. Examples of suitable cationic organic polymers include polymers prepared by polymerization of a water-soluble ethylenically unsaturated cationic monomer or, preferably, a monomer mixture comprising one or more water-soluble ethylenically unsaturated cationic monomers and optionally one or more other water-soluble ethylenically unsaturated monomers. Examples of suitable water-soluble ethylenically unsaturated cationic monomers include diallyl-dialkyl ammonium halides, e.g. diallyldimethyl ammonium chloride and cationic monomers represented by the general structural formula (II):

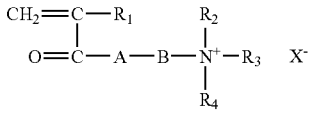

(II)

wherein $R_1$ is H or $CH_3$; $R_2$ and $R_3$ are each H or, preferably, a hydrocarbon group, suitably alkyl, having from 1 to 3 carbon atoms, preferably 1 to 2 carbon atoms; A is O or NH; B is an alkyl or alkylene group having from 2 to 8 carbon atoms, suitably from 2 to 4 carbon atoms, or a hydroxy propylene group; $R_4$ is H or, preferably, a hydrocarbon group, suitably alkyl, having from 1 to 4 carbon atoms, preferably 1 to 2 carbon atoms, or a substituent containing an aromatic group, suitably a phenyl or substituted phenyl group, which can be attached to the nitrogen by means of an alkylene group usually having from 1 to 3 carbon atoms, suitably 1 to 2 carbon atoms, suitable $R_4$ including a benzyl group ($—CH_2—C_6H_5$); and $X^-$ is an anionic counterion, usually a halide like chloride.

Examples of suitable monomers represented by the general structural formula (II) include quaternary monomers obtained by treating dialkylaminoalkyl(meth)acrylates, e.g. dimethyl-aminoethyl(meth)acrylate, diethylaminoethyl (meth)acrylate and dimethylaminohydroxypropyl(meth) acrylate, and dialkylaminoalkyl(meth)acrylamides, e.g. dimethylaminoethyl(meth)acryl-amide, diethylaminoethyl (meth)acrylamide, dimethylaminopropyl(meth)acrylamide, and diethyl-aminopropyl(meth)acrylamide, with methyl chloride or benzyl chloride. Preferred cationic monomers of the general formula (II) include dimethylaminoethyl acrylate methyl chloride quaternary salt, dimethylaminoethyl methacrylate methyl chloride quaternary salt, dimethyl-aminoethyl acrylate benzyl chloride quaternary salt and dimethylaminoethyl methacrylate benzyl chloride quaternary salt.

The monomer mixture can contain one or more water-soluble ethylenically unsaturated non-ionic monomers. Examples of suitable copolymerizable non-ionic monomers include acrylamide and acrylamide-based monomers, e.g. methacrylamide, N-alkyl(meth)acrylamides, e.g. N-methyl (meth)acrylamide, N-ethyl(meth)acrylamide, N-n-propyl (meth)acrylamide, N-isopropyl (meth)acrylamide, N-n-butyl (meth)acrylamide, N-t-butyl(meth)acrylamide and N-isobutyl (meth)acrylamide; N-alkoxyalkyl(meth)acrylamides, e.g. N-n-butoxymethyl(meth)acrylamide, and N-isobutoxymethyl(meth)acrylamide; N,N-dialkyl(meth)acrylamides, e.g. N,N-dimethyl (meth)acrylamide; dialkylaminoalkyl(meth) acrylamides; acrylate-based monomers like dialkyl-aminoalkyl(meth)acrylates; and vinylamines. The monomer mixture can also contain one or more water-soluble ethylenically unsaturated anionic or potentially anionic monomers, preferably in minor amounts. The term "potentially anionic monomer", as used herein, is meant to include a monomer bearing a potentially ionisable group which becomes anionic when included in a polymer on application to the cellulosic suspension. Examples of suitable copolymerizable anionic and potentially anionic monomers include ethylenically unsaturated carboxylic acids and salts thereof, e.g. (meth) acrylic acid and salts thereof, suitably sodium(meth)acrylate, ethylenically unsaturated sulphonic acids and salts thereof, e.g. 2-acrylamido-2-methylpropanesulphonate, sulphoethyl-(meth)acrylate, vinylsulphonic acid and salts thereof, styrenesulphonate, and paravinyl phenol (hydroxy styrene) and salts thereof. Examples of preferred copolymerizable monomers include acrylamide and methacrylamide, i.e. (meth) acrylamide, and examples of preferred cationic organic polymers include cationic acrylamide-based polymer, i.e. a cationic polymer prepared from a monomer mixture comprising one or more of acrylamide and acrylamide-based monomers The polymer P1 in the form of a cationic organic polymer can have a weight average molecular weight of at least 10,000, often at least 50,000. More often, it is at least 100,000 and usually at least about 500,000, suitably at least about 1 million and preferably above about 2 million. The upper limit is not critical; it can be about 30 million, usually 20 million.

Examples of preferred drainage and retention aids according to the invention include:

(i) cationic polysaccharide being cationic starch, and polymer P2 being anionic silica-based particles;
(ii) cationic polysaccharide being cationic starch, and polymer P2 being water-soluble or water-dispersible anionic acrylamide-based polymer;
(iii) polymer P1 being cationic acrylamide-based polymer, cationic polysaccharide being cationic starch, and polymer P2 being anionic silica-based particles;
(iv) polymer P1 being cationic polyaluminium compound, cationic polysaccharide being cationic starch, and polymer P2 being anionic silica-based particles;
(v) polymer P1 being cationic acrylamide-based polymer, cationic polysaccharide being cationic starch, and polymer P2 being water-soluble or water-dispersible anionic acrylamide-based polymer;

According to the present invention, the cationic polysaccharide, polymer P2, and, optionally, polymer P1 are added to the aqueous cellulosic suspension after it has passed through all stages of high mechanical shear and prior to drainage. Examples of high shear stages include pumping and cleaning stages. For instance, such shearing stages are included when the cellulosic suspension is passed through fan pumps, pressure screens and centri-screens. Suitably, the last point of high shear occurs at a centri-screen and, consequently, the cationic polysaccharide, polymer P2, and, optionally, polymer P1, are suitably added subsequent to the centri-screen. Preferably, after addition of the cationic polysaccharide, polymer P2, and, optionally, polymer P1, the cellulosic suspension is fed into the headbox which ejects the suspension onto the forming wire for drainage.

It may be desirable to further include additional materials in the process of the present invention. Preferably, these materials are added to the cellulosic suspension before it is passed through the last point of high shear. Examples of such additional materials include water-soluble organic polymeric coagulants, e.g. cationic polyamines, polyamideamines, polyethylene imines, dicyandiamide condensation polymers and low molecular weight highly cationic vinyl addition polymers; and inorganic coagulants, e.g. aluminium compounds, e.g. alum and polyaluminium compounds.

The cationic polysaccharide, polymer P2, and, optionally, polymer P1, can be separately added to the cellulosic suspension. In one embodiment, the cationic polysaccharide is added to the cellulosic suspension prior to adding polymer P2. In another embodiment, the polymer P2 is added to the cellulosic suspension prior to adding the cationic polysaccharide. Preferably, the cationic polysaccharide is added to the cellulosic suspension prior to adding polymer P2. If polymer P1 is used, it may be added to the cellulosic suspension prior to, simultaneous with, or after the cationic polysaccharide. Preferably polymer P1 is added to the cellulosic suspension prior to, or simultaneous with, the cationic polysaccharide. Polymer P1 may be added to the cellulosic suspension prior to or after the polymer P2. Preferably, polymer P1 is added to the cellulosic suspension prior to the polymer P2.

The cationic polysaccharide, polymer P2, and, optionally, polymer P1, according to the invention can be added to the cellulosic suspension to be dewatered in amounts which can vary within wide limits. Generally, the cationic polysaccharide, polymer P2, and, optionally, polymer P1, are added in amounts that give better drainage and retention than is obtained when not making the addition.

The cationic polysaccharide is usually added in an amount of at least about 0.001% by weight, often at least about 0.005% by weight, calculated as dry polymer on dry cellulosic suspension, and the upper limit is usually about 5.0, suitably about 2.0 and preferably about 1.5% by weight.

Similarly, the polymer P2 is usually added in an amount of at least about 0.001% by weight, often at least about 0.005% by weight, calculated as dry polymer or dry $SiO_2$ on dry cellulosic suspension, and the upper limit is usually about 2.0 and suitably about 1.5% by weight.

Likewise, the optional polymer P1 is, when used, usually added in an amount of at least about 0.001% by weight, often at least about 0.005% by weight, calculated as dry polymer on dry cellulosic suspension, and the upper limit is usually about 2.0 and suitably about 1.5% by weight.

The process of this invention is applicable to all papermaking processes and cellulosic suspensions, and it is particularly useful in the manufacture of paper from a stock that has a high conductivity. In such cases, the conductivity of the stock that is dewatered on the wire is usually at least about 1.5 mS/cm, preferably at least 3.5 mS/cm, and more preferably at least 5.0 mS/cm. Conductivity can be measured by standard equipment such as, for example, a WTW LF 539 instrument supplied by Christian Berner.

The present invention further encompasses papermaking processes where white water is extensively recycled, or recirculated, i.e. with a high degree of white water closure, for example where from 0 to 30 tons of fresh water are used per ton of dry paper produced, usually less than 20, preferably less than 15, more preferably less than 10 and notably less than 5 tons of fresh water per ton of paper. Fresh water can be introduced in the process at any stage; for example, fresh water can be mixed with cellulosic fibers in order to form a cellulosic suspension, and fresh water can be mixed with a thick cellulosic suspension to dilute it so as to form a thin cellulosic suspension to which the cationic polysaccharide, polymer P2, and, optionally, polymer P1, are added after all points of high shear.

The process according to the invention is used for the production of paper. The term "paper", as used herein, of course include not only paper and the production thereof, but also other web-like products, such as for example board and paperboard, and the production thereof. The process can be used in the production of paper from different types of suspensions of cellulosic fibers, and the suspensions should preferably contain at least 25% and more preferably at least 50% by weight of such fibers, based on dry substance. The suspensions can be based on fibers from chemical pulp, such as sulphate and sulphite pulp, thermo-mechanical pulp, chemo-thermomechanical pulp, organosolv pulp, refiner pulp or groundwood pulp from both hardwood and softwood, or fibers derived from one year plants like elephant grass, bagasse, flax, straw, etc., and can also be used for suspensions based on recycled fibers. The invention is preferably applied to processes for making paper from wood-containing suspensions.

The suspension also contain mineral fillers of conventional types, such as, for example, kaolin, clay, titanium dioxide, gypsum, talc and both natural and synthetic calcium carbonates, such as, for example, chalk, ground marble, ground calcium carbonate, and precipitated calcium carbonate. The stock can of course also contain papermaking additives of conventional types, such as wet-strength agents, sizing agents, such as those based on rosin, ketene dimers, ketene multimers, alkenyl succinic anhydrides, etc.

Preferably the invention is applied on paper machines producing wood-containing paper and paper based on recycled fibers, such as SC, LWC and different types of book and newsprint papers, and on machines producing wood-free printing and writing papers, the term wood-free meaning less than about 15% of wood-containing fibers. Examples of preferred applications of the invention include the production of paper and layer of multilayered paper from cellulosic suspensions containing at least 50% by weight of mechanical and/or recycled fibres. Preferably the invention is applied on paper machines running at a speed of from 300 to 3000 m/min and more preferably from 500 to 2500 m/min.

The invention is further illustrated in the following examples which, however, are not intended to limit the same. Parts and % relate to parts by weight and % by weight, respectively, unless otherwise stated.

EXAMPLES

The following components were used in the examples:

C-PAM Representing polymer P1. Cationic acrylamide-based polymer prepared by polymerisation of acrylamide (60 mole %) and acryloxyethyltrimethyl ammonium chloride (40 mole %), the polymer having a weight average molecular weight of about 3 million and cationic charge of about 3.3 meq/g.

C-PS 1: Cationic starch modified with 2,3-hydroxypropyl trimethyl ammonium chloride to a degree of cationic substitution ($DS_C$) of 0.05 and having a cationic charge density of about 0.3 meq/g.

C-PS 2: Cationic starch modified with 2,3-hydroxypropyl trimethyl ammonium chloride to a degree of cationic substitution ($DS_C$) of 0.11 and having a cationic charge density of about 0.6 meq/g.

Silica Representing polymer P2. Anionic inorganic condensation polymer of silicic acid in the form of colloidal aluminium-modified silica sol having an S value of about 21 and containing silica-based particles with a specific surface area of about 800 $m^2/g$.

A-PAM: Representing polymer P2. Anionic acrylamide-based polymer prepared by polymerisation of acrylamide (80 mole %) and acrylic acid (20 mole %), the polymer having a weight average molecular weight of about 12 million and anionic charge density of about 2.6 meq/g.

A-X-PAM: Representing polymer P2. Anionic crosslinked acrylamide-based polymer prepared by polymerisation of acrylamide (30 mole %) and acrylic acid (70 mole %), the polymer having a weight average molecular weight of about 100.000 and anionic charge density of about 8.0 meq/g.

Example 1

Drainage performance was evaluated by means of a Dynamic Drainage Analyser (DDA), available from Akribi, Sweden, which measures the time for draining a set volume of stock through a wire when removing a plug and applying vacuum to that side of the wire opposite to the side on which the stock is present.

Retention performance was evaluated by means of a nephelometer, available from Novasina, Switzerland, by measuring the turbidity of the filtrate, the white water, obtained by draining the stock. The turbidity was measured in NTU (Nephelometric Turbidity Units).

The stock used in the test was based on 75% TMP and 25% DIP fibre material and bleach water from a newsprint mill. Stock consistency was 0.76%. Conductivity of the stock was 1.5 mS/cm and the pH was 7.1.

In order to simulate additions after all points of high shear, the stock was stirred in a baffled jar at different stirrer speeds. Stirring and additions were made according to the following:

(i) stirring at 1000 rpm for 25 seconds,
(ii) stirring at 2000 rpm for 10 seconds,
(iii) stirring at 1000 rpm for 15 seconds while making additions, and
(iv) dewatering the stock while automatically recording the dewatering time.

Additions to the stock were made as follows: The first addition (addition levels of 5, 10 or 15 kg/t) was made 25 or 15 seconds prior to dewatering and the second addition (addition levels of 5, 10 or 15 kg/t) was made 5 seconds prior to dewatering.

Table 1 shows the dewatering effect at different addition points. The cationic starch addition levels were calculated as dry product on dry stock system, and the silica-based particles were calculated as $SiO_2$ and based on dry stock system.

Test No. 1 shows the result without any additives. Test Nos. 2 to 6, 8, 10 to 14 and 16 illustrate processes used for comparison (Ref.) and Test Nos. 7, 9, 15 and 17 illustrate processes according to the invention.

TABLE 1

| Test No. | First Addition | Second Addition | Addition Time [s] $1^{st.}/2^{nd}$ | Addition Levels [kg/t] $1^{st.}/2^{nd}$ | Dewatering Time [s] | Turbidity [NTU] |
|---|---|---|---|---|---|---|
| 1 | — | — | — | — | 85.2 | 132 |
| 2 | C-PS 1 | Silica | 25/— | 10/— | 73.2 | 62 |
| 3 | C-PS 1 | Silica | 15/— | 10/— | 54.8 | 61 |
| 4 | C-PS 1 | Silica | 25/— | 15/— | 81.6 | 70 |
| 5 | C-PS 1 | Silica | 15/— | 15/— | 57.1 | 57 |
| 6 | C-PS 1 | Silica | 25/5 | 10/0.5 | 54.5 | 53 |
| 7 | C-PS 1 | Silica | 15/5 | 10/0.5 | 46.4 | 61 |
| 8 | C-PS 1 | Silica | 25/5 | 15/0.5 | 49.9 | 59 |
| 9 | C-PS 1 | Silica | 15/5 | 15/0.5 | 38.2 | 62 |
| 10 | C-PS 2 | Silica | 25/— | 5/— | 57.5 | 66 |
| 11 | C-PS 2 | Silica | 15/— | 5/— | 51.7 | 61 |
| 12 | C-PS 2 | Silica | 25/— | 10/— | 48.7 | 59 |
| 13 | C-PS 2 | Silica | 15/— | 10/— | 36.6 | 52 |
| 14 | C-PS 2 | Silica | 25/5 | 5/0.5 | 52.9 | 61 |
| 15 | C-PS 2 | Silica | 15/5 | 5/0.5 | 48.7 | 52 |
| 16 | C-PS 2 | Silica | 25/5 | 10/0.5 | 28.3 | 43 |
| 17 | C-PS 2 | Silica | 15/5 | 10/0.5 | 25.5 | 51 |

It is evident from Table 1 that the process according to the present invention resulted in improved dewatering at the same time the retention behaviour is about the same.

Example 2

Drainage performance and retention were evaluated according to Example 1.

The stock used in the test was based on 75% TMP and 25% DIP fibre material and bleach water from a newsprint mill. Stock consistency was 0.78%. Conductivity of the stock was 1.4 mS/cm and the pH was 7.8.

In order to simulate additions after all points of high shear, the stock was stirred in a baffled jar at different stirrer speeds. Stirring and additions were made according to the following:

(v) stirring at 1500 rpm for 25 seconds,
(vi) stirring at 2000 rpm for 10 seconds,
(vii) stirring at 1500 rpm for 15 seconds, while making additions according to the invention, and,
(viii) dewatering the stock while automatically recording the dewatering time.

Additions to the stock were made as follows: The first addition was made 25 or 15 seconds prior to dewatering and the second addition was made 5 seconds prior to dewatering. Additions to the stock were made as follows: The first addition (addition levels of 5 or 10 kg/t) was made 25 or 15 seconds prior to dewatering and the second addition (addition level of 0.1 kg/t) was made 5 seconds prior to dewatering.

Table 4 shows the dewatering effect at different addition points. The addition levels were calculated as dry product on dry stock system.

Test No. 1 shows the result without any additives. Test Nos. 2, 3, 4 and 6 illustrate processes employing additives used for comparison (Ref.) and Test Nos. 5 and 7 illustrate processes according to the invention.

TABLE 2

| Test No. | First Addition | Second Addition | Addition Time [s] $1^{st.}/2^{nd}$ | Addition Levels [kg/t] $1^{st.}/2^{nd}$ | Dewatering Time [s] | Turbidity [NTU] |
|---|---|---|---|---|---|---|
| 1 | — | — | — | — | 85.3 | 138 |
| 2 | C-PS 2 | — | 25/— | 10/— | 51.9 | 74 |
| 3 | C-PS 2 | — | 15/— | 10/— | 43.2 | 72 |
| 4 | C-PS 2 | A-X-PAM | 25/5 | 10/0.1 | 34.6 | 58 |
| 5 | C-PS 2 | A-X-PAM | 15/5 | 10/0.1 | 33.3 | 55 |
| 6 | C-PS 2 | A-X-PAM | 25/5 | 5/0.1 | 57.2 | 83 |
| 7 | C-PS 2 | A-X-PAM | 15/5 | 5/0.1 | 48.7 | 72 |

It is evident from Table 2 that the process according to the present invention resulted in improved dewatering and retention.

Example 3

Drainage performance and retention were evaluated according to Example 1.

The stock used in the test was based on 75% TMP and 25% DIP fibre material and bleach water from a newsprint mill. Stock consistency was 0.61%. Conductivity of the stock was 1.6 mS/cm and the pH was 7.6.

In order to simulate additions after all points of high shear, the stock was stirred in a baffled jar at different stirrer speeds. Stirring and additions were made according to the following:

(ix) stirring at 1500 rpm for 25 seconds,
(x) stirring at 2000 rpm for 10 seconds,
(xi) stirring at 1500 rpm for 15 seconds, while making additions according to the invention, and,
(xii) dewatering the stock while automatically recording the dewatering time.

Additions to the stock were made as follows (addition levels in kg/t): The optional polymer P1 was added 45 or 15 seconds prior to dewatering, the cationic polysaccharide was added 25 or 10 seconds prior to dewatering and the polymer P2 was added 5 seconds prior to dewatering.

Additions to the stock were made as follows: The first addition (addition level of 0.5 kg/t) was made 45 or 15 seconds prior to dewatering, the second addition (addition levels of 5, 10 or 15 kg/t) was made 25 or 10 seconds prior to dewatering and the third addition (addition level of 2 kg/t) was made 5 seconds prior to dewatering.

Table 1 shows the dewatering effect at different addition points. The addition levels were calculated as dry product on dry stock system, and the silica-based particles were calculated as $SiO_2$ and based on dry stock system.

Test No. 1 shows the result without any additives. Test Nos. 2 to 7, 9 to 11 and 13 to 15 illustrate processes used for comparison (Ref.) and Test Nos. 8, 12 and 16 illustrate processes according to the invention.

TABLE 3

| Test No. | First Addition | Second Addition | Third Addition | Addition Time [s] $1^{st}/2^{nd}/3^{rd}$ | Addition Levels [kg/t] $1^{st}/2^{nd}/3^{rd}$ | Dewatering Time [s] | Turbidity [NTU] |
|---|---|---|---|---|---|---|---|
| 1 | — | — | — | — | — | 54.1 | 134 |
| 2 | C-PAM | — | — | 15/—/— | 0.5/—/— | 41.1 | 80 |
| 3 | C-PAM | — | Silica | 45/—/5 | 0.5/—/2 | 49.4 | 94 |
| 4 | C-PAM | — | Silica | 15/—/5 | 0.5/—/2 | 43.2 | 97 |
| 5 | C-PAM | C-PS 1 | Silica | 45/25/5 | 0.5/5/2 | 28.5 | 76 |
| 6 | C-PAM | C-PS 1 | Silica | 45/10/5 | 0.5/5/2 | 24.8 | 78 |
| 7 | C-PAM | C-PS 1 | Silica | 15/25/5 | 0.5/5/2 | 26.2 | 75 |
| 8 | C-PAM | C-PS 1 | Silica | 15/10/5 | 0.5/5/2 | 20.8 | 73 |
| 9 | C-PAM | C-PS 1 | Silica | 45/25/5 | 0.5/10/2 | 18.5 | 72 |
| 10 | C-PAM | C-PS 1 | Silica | 45/10/5 | 0.5/10/2 | 17.0 | 70 |
| 11 | C-PAM | C-PS 1 | Silica | 15/25/5 | 0.5/10/2 | 17.2 | 74 |
| 12 | C-PAM | C-PS 1 | Silica | 15/10/5 | 0.5/10/2 | 15.4 | 65 |
| 13 | C-PAM | C-PS 1 | Silica | 45/25/5 | 0.5/15/2 | 17.9 | 73 |
| 14 | C-PAM | C-PS 1 | Silica | 45/10/5 | 0.5/15/2 | 16.6 | 69 |
| 15 | C-PAM | C-PS 1 | Silica | 15/25/5 | 0.5/15/2 | 15.3 | 73 |
| 16 | C-PAM | C-PS 1 | Silica | 15/10/5 | 0.5/15/2 | 15.1 | 63 |

It is evident from Table 3 that the process according to the present invention resulted in improved dewatering and retention.

Example 4

Drainage performance and retention were evaluated according to Example 2. The same stock and stirring sequences were used as in Example 2.

Additions to the stock were made as follows: The first addition (addition level of 0.5 kg/t) was made 45 or 15 seconds prior to dewatering, the second addition (addition level of 5 kg/t) was made 25 or 10 seconds prior to dewatering and the third addition (addition level of 2 kg/t) was made 5 seconds prior to dewatering.

Table 2 shows the dewatering effect at different addition points. The addition levels were calculated as dry product on dry stock system, and the silica-based particles were calculated as $SiO_2$ and based on dry stock system.

Test No. 1 shows the result without any additives. Test Nos. 2 to 4 illustrate processes used for comparison (Ref.) and Test No. 5 illustrates the process according to the invention.

TABLE 4

| Test No. | First Addition | Second Addition | Third Addition | Addition Time [s] $1^{st}/2^{nd}/3^{rd}$ | Addition Levels [kg/t] $1^{st}/2^{nd}/3^{rd}$ | Dewatering Time [s] | Turbidity [NTU] |
|---|---|---|---|---|---|---|---|
| 1 | — | — | — | — | — | 54.1 | 134 |
| 2 | C-PAM | C-PS 2 | Silica | 45/25/5 | 0.5/5/2 | 14.9 | 75 |
| 3 | C-PAM | C-PS 2 | Silica | 45/10/5 | 0.5/5/2 | 14.5 | 66 |
| 4 | C-PAM | C-PS 2 | Silica | 15/25/5 | 0.5/5/2 | 17.3 | 73 |
| 5 | C-PAM | C-PS 2 | Silica | 15/10/5 | 0.5/5/2 | 13.5 | 64 |

It is evident from Table 4 that the process according to the present invention resulted in improved dewatering and retention.

Example 5

Drainage performance and retention were evaluated according to Example 1. The same stirring sequences were used as in Example 2.

Additions to the stock were made as follows: The first polymer was added 45 or 15 seconds prior to dewatering, the second polymer was added 25 or 10 seconds prior to dewatering and the third polymer was added 5 seconds prior to dewatering.

Additions to the stock were made as follows: The first addition (addition level of 0.5 kg/t) was made 45 or 15 seconds prior to dewatering, the second addition (addition level of 10 kg/t) was made 25 or 10 seconds prior to dewatering and the third addition (addition levels of 0.5+0.1 kg/t or 0.1 kg/t) was made 5 seconds prior to dewatering.

The stock used in the test was based on 75% TMP and 25% DIP fibre material and bleach water from a newsprint mill. Stock consistency was 0.78%. Conductivity of the stock was 1.4 mS/cm and the pH was 7.8.

Table 3 shows the dewatering effect at different addition points. The addition levels were calculated as dry product on dry stock system, and the silica-based particles were calculated as $SiO_2$ and based on dry stock system.

Test No. 1 shows the result without any additives. Test Nos. 2, 3, 4 and 6 to 8 illustrate processes used for comparison (Ref.) and Test Nos. 5 and 9 illustrate processes according to the invention.

TABLE 5

| Test No. | First Addition | Second Addition | Third Addition | Addition Time [s] $1^{st.}/2^{nd}/3^{rd}$ | Addition Levels [kg/t] $1^{st.}/2^{nd}/3^{rd}$ | Dewatering Time [s] | Turbidity [NTU] |
|---|---|---|---|---|---|---|---|
| 1 | — | — | — | — | — | 85.3 | 138 |
| 2 | C-PAM | C-PS 2 | Silica + A-PAM | 45/25/5 | 0.5/10/ 0.5 + 0.1 | 19.9 | 33 |
| 3 | C-PAM | C-PS 2 | Silica + A-PAM | 45/10/5 | 0.5/10/ 0.5 + 0.1 | 18.5 | 37 |
| 4 | C-PAM | C-PS 2 | Silica + A-PAM | 15/25/5 | 0.5/10/ 0.5 + 0.1 | 15.1 | 43 |
| 5 | C-PAM | C-PS 2 | Silica + A-PAM | 15/10/5 | 0.5/10/ 0.5 + 0.1 | 13.6 | 38 |
| 6 | C-PAM | C-PS 2 | A-X-PAM | 45/25/5 | 0.5/10/0.1 | 30.6 | 49 |
| 7 | C-PAM | C-PS 2 | A-X-PAM | 45/10/5 | 0.5/10/0.1 | 24.8 | 46 |
| 8 | C-PAM | C-PS 2 | A-X-PAM | 15/25/5 | 0.5/10/0.1 | 25.6 | 56 |
| 9 | C-PAM | C-PS 2 | A-X-PAM | 15/10/5 | 0.5/10/0.1 | 22.6 | 43 |

It is evident from Table 5 that the process according to the present invention resulted in improved dewatering at the same time the retention behaviour is about the same.

The invention claimed is:

1. A process for producing paper which comprises:

(i) providing an aqueous suspension comprising cellulosic fibers, (ii) adding to the suspension after all points of high shear:

a polymer P1 being a water-soluble cationic acrylamide-based polymer having an average molecular weight of at least about 1,000,000 prepared by polymerizing a composition comprising a monomer mixture comprising one or more cationic monomers represented by the general structural formula (II)

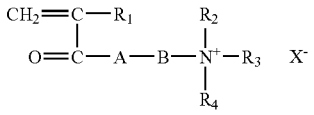

(II)

wherein $R_1$ is H or $CH_3$; $R_2$ and $R_3$ are each H or a hydrocarbon group having from 1 to 2 carbon atoms; A is O; B is an alkyl or alkylene group having from 2 to 8 carbon atoms; $R_4$ is H or a hydrocarbon group having from 1 to 2 carbon atoms; and $X^-$ is an anionic counterion;

a cationic starch having a degree of cationic substitution ($DS_C$) from 0.01 to 0.5, a charge density of from about 0.05 to about 6.0 meq/g and a weight average molecular weight of above about 1,000,000; and a polymer P2 being an anionic polymer selected from anionic silica-based polymers comprising anionic silica-based particles having an average particle size in the range of from about 1 to about 10 nm, and a specific surface area within the range of from 50 to 1000 $m^2/g$; and (iii) dewatering the obtained suspension to form paper.

2. The process according to claim 1, wherein the cationic starch has a degree of cationic substitution ($DS_C$) within the range of from about 0.025 to about 0.2.

3. The process according to claim 1, wherein the cationic starch has a cationic charge density within the range of from about 0.1 to about 5.0 meq/g.

4. The process according to claim 1, wherein the anionic silica-based polymers are prepared by condensation polymerization of siliceous compounds.

5. The process according to claim 1, wherein the one or more cationic monomers are chosen from dimethylammoniumethyl acrylate methyl chloride, dimethylammoniumethyl methacrylate methyl chloride, diethylammoniumethyl acrylate methyl chloride, diethylammoniumethyl methacrylate methyl chloride, or mixtures thereof.

6. The process according to claim 1, wherein the one or more cationic monomers are chosen from dimethylaminoethyl acrylate methyl chloride quaternary salt, and dimethylaminoethyl methacrylate methyl chloride quaternary salt, or mixtures thereof.

7. A process for producing paper which comprises:

(i) providing an aqueous suspension comprising cellulosic fibers, (ii) adding to the suspension after all points of high shear:

a polymer P1 being a water-soluble cationic acrylamide-based polymer having an average molecular weight of at least about 1,000,000 prepared by polymerizing a composition comprising a monomer mixture comprising one or more cationic monomers represented by the general structural formula (II)

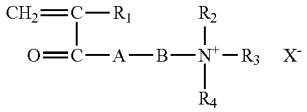

(II)

wherein $R_1$ is H or $CH_3$, $R_2$ and $R_3$ are each H or a hydrocarbon group having from 1 to 2 carbon atoms; A is O; B is an alkyl or alkylene group having from 2 to 8 carbon atoms; $R_4$ is H or a hydrocarbon group having from 1 to 2 carbon atoms; and $X^-$ is an anionic counterion;

a cationic polysaccharide having a degree of substitution (DSc) within the range of from about 0.01 to about 0.5 and a weight average molecular weight of above about 1,000,000; and a polymer P2 being an anionic polymer selected from anionic silica-based polymers comprising anionic silica-based particles having an average particle size in the range of from about 1 to about 10 nm, and a specific surface area within the range of from 50 to 1000 $m^2/g$;

said points of high shear comprising pumping and cleaning stages; the obtained suspension from step (ii) being fed to a headbox which ejects the suspension comprising polymer P1, cationic starch, and polymer P2 onto a forming wire for drainage to form paper, wherein the stages of pumping and cleaning comprise fan pumps, pressure screens and centri-screens.

8. The process according to claim 7, wherein the last point of high shear occurs at a centri-screen.

9. The process according to claim 7, wherein the cationic polysaccharide is cationic starch.

10. The process according to claim 7, wherein the cationic polysaccharide has a degree of substitution ($DS_C$) within the range of from about 0.02 to about 0.3.

11. The process according to claim 7, wherein the cationic polysaccharide has a cationic charge density within the range of from about 0.05 to about 6.0 meq/g.

12. The process according to claim 7, wherein the anionic silica-based polymers are prepared by condensation polymerization of siliceous compounds.

13. The process according to claim 7, wherein the one or more cationic monomers are chosen from dimethylammoniumethyl acrylate methyl chloride, dimethylammoniumethyl methacrylate methyl chloride, diethylammoniumethyl acrylate methyl chloride, diethylammoniumethyl methacrylate methyl chloride, or mixtures thereof.

14. The process according to claim 7, wherein the one or more cationic monomers are chosen from dimethylaminoethyl acrylate methyl chloride quaternary salt, and dimethylaminoethyl methacrylate methyl chloride quaternary salt, or mixtures thereof.

* * * * *